United States Patent [19]

Hughes, Sr.

[11] Patent Number: 4,856,404

[45] Date of Patent: Aug. 15, 1989

[54] GUITAR WITH TUNING CHANGING, KEY CHANGING, CHORD CHANGING AND MODULATING CAPABILITIES

[76] Inventor: Samuel G. Hughes, Sr., c/o Mrs. Jobie Kessler, P.O. Box 136, Mallory, W. Va. 25634

[21] Appl. No.: 136,966

[22] Filed: Dec. 23, 1987

[51] Int. Cl.[4] ..... G10D 3/00

[52] U.S. Cl. ..... 84/297 R; 84/312 R; 84/313; 84/318

[58] Field of Search ..... 84/312, 318, 312 P, 84/317, 298, 304, 313

[56] References Cited

U.S. PATENT DOCUMENTS

| | | | |
|---|---|---|---|
| 743,054 | 11/1903 | Bergren | 84/318 |
| 2,746,337 | 5/1956 | Smit | 84/317 |
| 4,170,161 | 10/1979 | Kaftan | 84/312 R |
| 4,334,457 | 6/1982 | Spoonts, III | 84/318 |
| 4,621,558 | 11/1986 | Cornette | 84/318 |
| 4,686,883 | 8/1987 | Piche et al. | 84/312 R |

*Primary Examiner*—L. T. Hix
*Assistant Examiner*—Brian W. Brown
*Attorney, Agent, or Firm*—Gerald J. Ferguson, Jr.

[57] ABSTRACT

A guitar with an improved mechanical selection of various tunings without fast skill or practice being required on the part of the player of the instrument. A positive stop and lever system enables the player to change tuning or key at will and to return back to standard tuning if so desired with a quick movement of a simple readily accessible key changing handle. An additional improved movable capo device for use on the guitar or any string instrument which is capable of a smooth transfer to any position on the neck within the octave without jerky or otherwise unsteady movement, capable of being moved to change any major key or chord within the music scale, including sharps and flats, as well as being usable as a modulating device to modulate in whole or half steps.

23 Claims, 5 Drawing Sheets

GUITAR WITH TUNING CHANGING, KEY CHANGING, CHORD CHANGING AND MODULATING CAPABILITIES

BACKGROUND OF THE INVENTION

This invention relates to the stringed instrument family and more directly to the guitar. The improved guitar of the present invention has a new improved capo assembly which has the capability to cover the complete scale octave on the fretboard of the guitar to make it possible to modulate a musical key forward and backward, without changing the player's preferred chord arrangements. It permits rapid key changing and working in unison with a rapid positive stop tuning changer, to enable the player to play in any key of the musical scale with any desired tuning he or she prefers, and to return to normal playing position with split second timing.

The tuning bridge of the present invention has easily accessible means for adjusting individual strings through the top plate of the tuning bridge with positive stop up and down of the pivoting levers. The tuning levers can be adjusted individually while in an active position. Also, on the improved capo of the present invention, independent tension adjustments for each string can be adjusted while in an active position.

The present invention also enhances the ease of playing technique for the untrained musician, by enabling the untrained musician to have in tune musical chords for harmonious comparison, without requiring training of the hands. This greatly enhances the learning process.

On the other hand, the present invention also enables the more skilled professional musician to have more tunings and key positions to work from, greatly aiding him in developing different styles and root positions while having the aid of harmonious overtones for comparison, and while working through scales, runs and chord buildup.

Additionally, a beginner can learn to play a song by the simple changing of a lever on the tuning changer or the moving of the capo to a simple fret position.

For the professional musician, the precision capo can be moved to a perfect chord arrangement, leaving the player's hands completely free to pursue note arrangements and chord buildup with double harmonies or harmonious overtones, thus greatly enhancing the development of individual styles.

There exists a need for an instrument that can speed up the learning process for would-be musicians by enabling the musician to achieve more harmonious tone relations, so as to hold the interest of the player. Also, the professional musician needs to be freed from the burden of having to use many separate instruments to perform desired musical tone relations. Moreover, there exists the need for an instrument that is capable of adjusting tuning variations and key changes without the aid of springs or extra tools or devices.

The present invention is designed for quick, easy and very accurate one-step operation, featuring positive stop in and out with split second timing.

SUMMARY OF THE INVENTION

In order to achieve the above-mentioned goals, a new and improved precision capo assembly is provided which has precision mounting and a fully adjustable individual free floating tension rollers which has a fully adjustable individual free floating tension roller system with individualized tension adjustments.

Further provided is an individual quick change positive stop for adjusting precise tension on individual strings on a quick change tuning bridge for changing multiple tensions on the guitar strings for different desired pitches. There is easy accessibility and easy adjustment for the precise pivot arms through the top of the tuning box while in an active position. There is a precision movable capo at the end of the guitar neck with a positive stop and a free floating self alignment and independent tension adjustment roller system.

The device is provided with an improved tuning changer bridge with independent string adjustments for string height and a back and forth adjustment for adjusting the harmonic pitch of each individual string while sustained on an independent roller. Located in the top plate of the quick change tuning changer are independent positive stop pivot arm adjustments for each individual string while in an active tuning position.

The device of the present invention features a new improved capo for precision quick change chording for modulating to different keys for the accurate individual tension adjustments. Two independent roller systems inside of the quick change tuning bridge bottom plate are provided to relieve stress and wear on the strings inside of the tuning changer, with the strings hooked in seated positions at the bottom of the positive stop pivot arms with individual precision holding slots.

The improved guitar of the present invention is provided with independent horizontal shafts through the top cover of the tuning bridge with locked one levers and stop pins on the side plate for accurate stop with easy tuning adjustment through the independent tuning camshafts.

Three independent tuning camshafts with independent adjustment screws in each shaft will save time in adjustment, should a tuning screw need adjusting, by not having to sort through other tunings, should the tunings be on a single bar. The horizontal camshafts have independent quick change levers for faster in and out tuning changes. No second step or springs are needed, because the tuning changer is designed to operate under normal string tension and from standard pitch tuning. Tunings can be changed instantly without any added tools or further steps.

The top cover with independent tuning shafts has independent slots through which the pivot bars can be independently adjusted while the tuning camshaft is in a locked position.

Additionally, slots at the front string holding rollers can be adjusted for individual string height. Also, two precision alignment dowel pins are provided where the cover can be removed and replaced to perfect the alignment position.

The present invention advantageously provides individual units which work in complete harmony with each other to give a musician a wide variety of tuning and key positions to play from, while freeing the noting hand from having to bar the neck, thus leaving it free to pursue different styles and chord buildup, while having unison string harmonies for background.

DETAILED DESCRIPTION OF THE INVENTION

Figure 1:
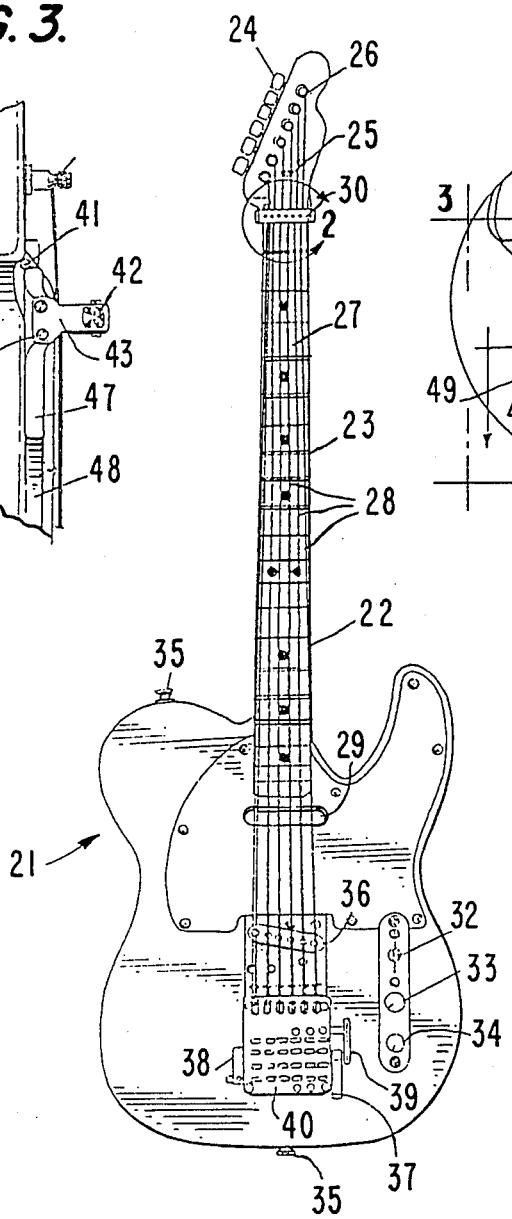
FIG. 1 is a top plan view illustrating the guitar in assembled working condition with the new improved capo in inactive position and the multiple tuning and key changer in a starting position of perfect pitch standard tune.
Figure 12:
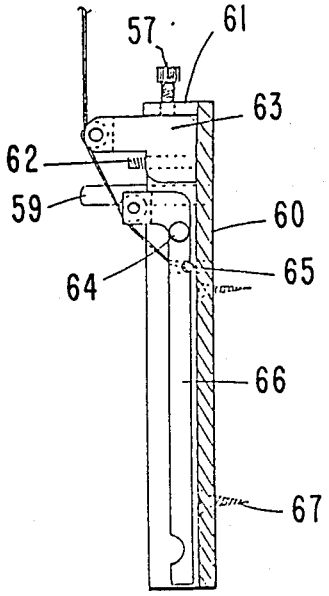
FIG. 12 is a cut-away sectional view of FIG. 11 showing pivot arms in position, with the adjustment screws for string height and intonation, and the top plate locking pin, with string mounting.

As referred to in FIG. 1, a guitar 21 includes an elongated neck 22 which supports six strings under tension, said strings being separated by tuning pegs 26 and adjusted to standard pitch by keys 24 and suspended at the other end to the pivot arm 66 shown in FIG. 12. The arm 66 is fastened to shaft 64. The shaft 64 is held in frame 60 which is the bottom half of the multiple tuning bridge key changer which works in conjunction with the sliding capo chord changer 30 of the encircled region of FIG. 1.

The sliding capo chord changer is provided to work in harmony with the multiple tuning unit 40 to produce any open tuning from any major key desired within the chromatic music scale, including sharps or flats.

By simply raising the quick change lever 38 the musician can, for example, go from standard tuning into an open D tuning. By moving the capo unit 30, two frets being represented by number 23, in reference to the moving capo unit 30 being guided by oval shaped grooves 48 (FIG. 3) the musician would be in an open E tuning. One more fret position would give an open F tuning.

Figure 3:
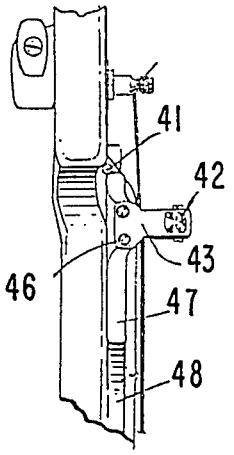
FIG. 3 is a sectional view taken from FIG. 2, lines 3, showing a side view of the improved capo and related oval holding groove.
Figure 2:
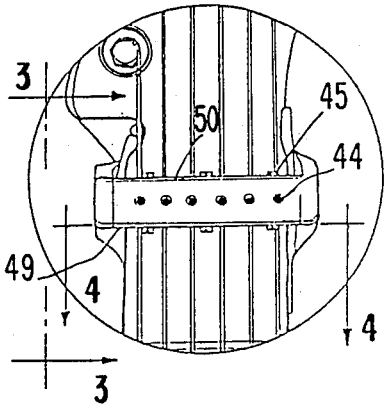
FIG. 2 is an enlarged top plan view of the improved capo showing it in dormant position resting against the solid top centered on the front bridge of the guitar neck relating to the encircled region 2 of FIG. 1.

Capo unit 30 can be modulated down the neck 22 to provide any key in the chromatic music scale or any major chord. At the end of oval groove 48 on neck 22 one would reach an open D tuning in the second octave, and by simply returning unit 30 capo and key changer capo to its dormant position against stop 41 as shown in FIG. 3 and depressing quick change lever 38 on the multiple tuning changer 40, the musician would be back in standard tuning.

Figure 4:
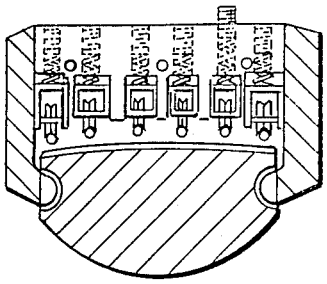
FIG. 4 is a cross-sectional view of FIG. 2 represented by lines 4 showing the free floating, independent roller system of the improved capo and chord changer with slide oval shaped side grooves represented and front plate removed.
Figure 5:
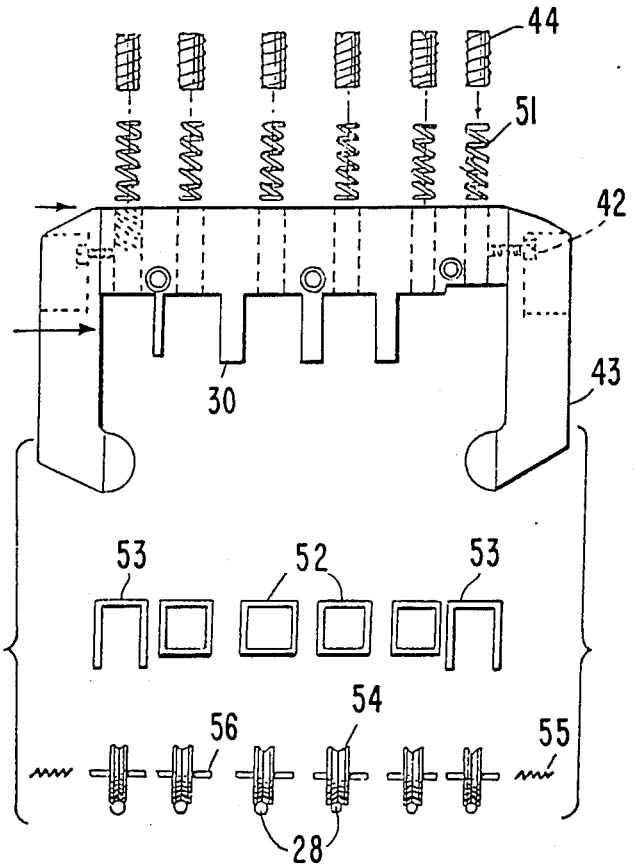
FIG. 5 is an enlarged front view of the capo showing the disassembled parts with front and back covers removed.
Figure 6:
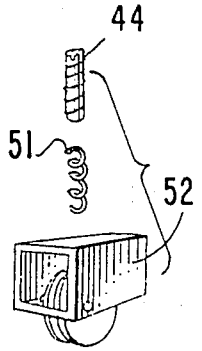
FIG. 6 is an enlargement showing one of four of the independent roller systems with tension spring and adjusting screw.
Figure 7:
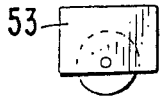
FIG. 7 is an enlarged side view of one of the two independent systems.
Figure 9:
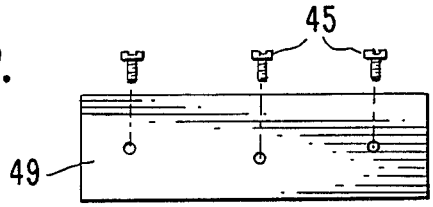
FIG. 9 is an enlarged view of the front cover plate of the capo.
Figure 8:
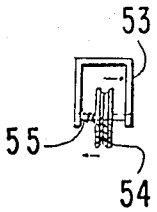
FIG. 8 is an enlarged front view of one of the two independent side rollers in assembled form with side tension spring.
Figure 10:
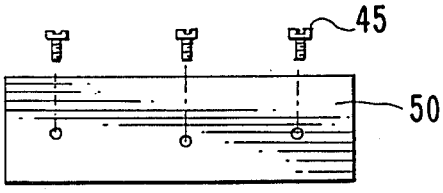
FIG. 10 is an enlarged view of the back cover plate of the capo.

With reference to unit 30 as shown in FIG. 1, (the capo key changer modulating device composed of the parts shown in FIGS. 5–10), a spring loaded free floating roller system is comprised of 6 independent rollers 54 and two U-shaped frames 53 rollers 54 being supported by shafts 56 mounted in housings 52 and 53 shown assembled in FIG. 6 and FIG. 7 which are set in place in housing 43 of FIG. 5, and better illustrated in completely assembled view as shown in FIG. 4. As can be seen from FIGS. 7 and 8, the outer most independent rollers 54 are spring biased inwardly-lowered the other independent rollers 54 by spring 55.

Independent roller housings 52 and 53 are suspended in housing 43 and independent adjustments are made by individual tension springs 51 and adjustment screws 44. Each independent roller system rides on strings 28 and is independently adjusted to each individual string tension. The capo key change modulator is held in place by oval shaped grooves 48 shown in FIG. 3 and covered by the front and back plates shown in FIGS. 9 and 10. The capo key change modulator is held together by screws 45 shown in FIG. 5. The capo key changing unit is adjusted while suspended on strings 28 with height adjustment screws 42, and individual adjustment screws 44 are adjusted to the tension desired to hold each string independently.

The capo unit can be moved to any position desired on the fretboard 27 in FIG. 1 to any position within one whole octave.

With reference to the multiple tuning and key changer bridge mounted on guitar body 21 (FIG. 1), this has two magnetic wound electrical pickups 29 and 36 which are hooked to a three way electrical switch 32 for the purpose of switching to one or the other or both for different tone variations.

The string vibrations 8 are picked up by the pickups and are further connected to a volume control 33 and a tone control 34 which can be further connected to an amplifier (not shown) for the purpose of producing loud high frequency sound.

Guitar 21 can be held by a performer suspended by a strap (not shown) held by the holding buttons 35 and chorded with the left hand and strummed or picked with the right hand. In front of the multiple tuning and key changing bridge unit 40 (FIG. 1) are provided quick change levers 37–39 for the purpose of changing to other tunings such as an open D tuning, G or E or any other tuning which might be desired.

The bridge unit 40 works in unison with capo unit 30 to cover any key in the chromatic music scale.

Figure 13:
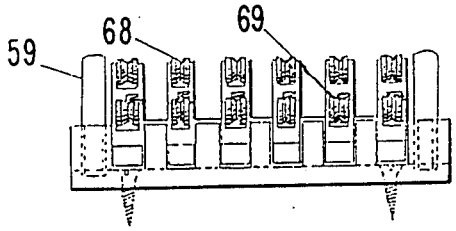
FIG. 13 is an end view of the bottom half of the multiple tuning bridge, showing alignment of roller systems locating pins and mounting screws.
Figure 14:
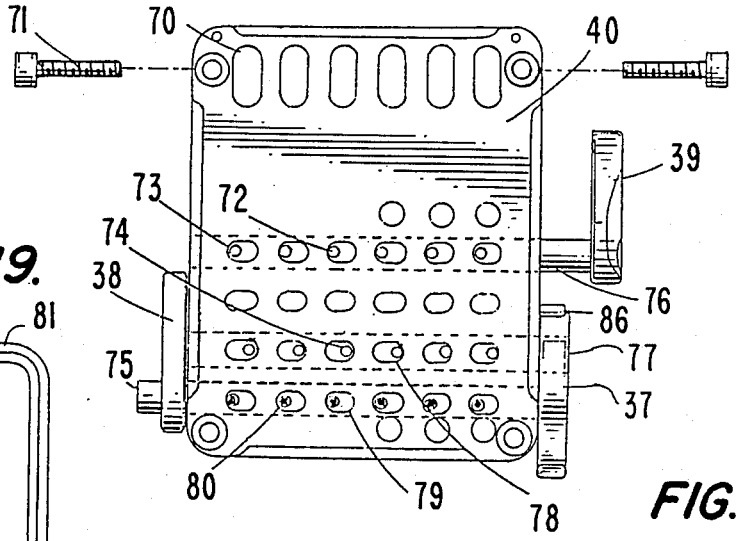
FIG. 14 is a top view of the top plate of the multiple tuning bridge showing quick change levers in standard tuning working position with adjustment tuning screws shown and adjustment tuning slots for adjusting the camshaft and various tunings while in working position.

For further details of said unit 40, the bottom half of unit 40 is further shown in FIG. 12 represented by number 60 and comprised of two completely independent roller systems 68 and 69 (FIG. 13) with two precision locating pins represented by the number 59 in FIGS. 12 and 13.

Figure 11:
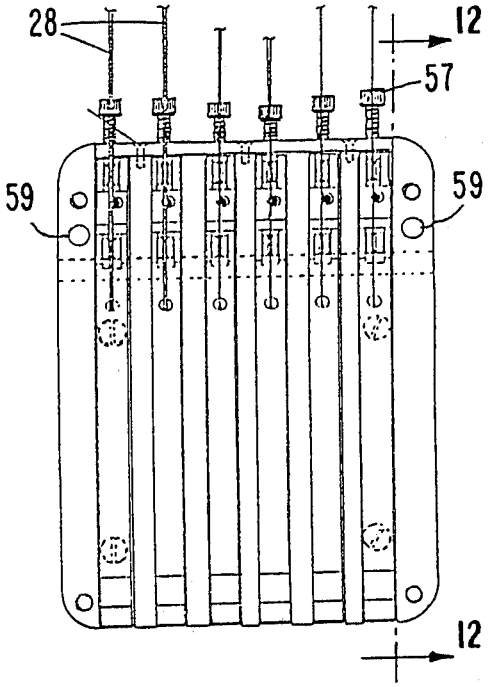
FIG. 11 is a top view of the bottom half of the multiple tuning changer, showing independent roller systems and pivot arms.

With reference to FIG. 11 there are six adjusting screws 57 which are held by a front plate 61 (FIG. 12). Front plate 61 is mounted to base plate 60 by three screws 58 (FIG. 11). The above mentioned screws 57 are for adjusting the intonation pitch of each individual string while suspended on rollers 68 (Fig.

Figure 19:
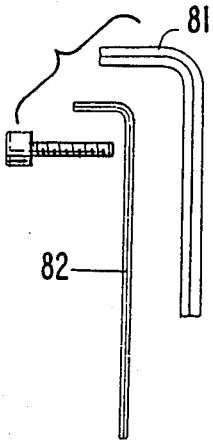
FIG. 19 illustrates the wrench for tuning adjustment screws and the wrench for removing the top cover plate.
Figure 20:
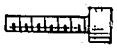
FIG. 20 illustrates the top cover plate holding screws.

As a further adjustment, the height of reference strings 28 can be independently adjusted using Allen screw 62 (FIG. 12) by means of the wrench 82 (FIG. 19). By turning screw 62 one can raise or lower unit 63 to the desired individual string height. The strings are mounted into fitted slots 65 in the bottom of each L-shaped arm 66 and the L-shaped pivot arms are held in positioned slots of frame 60 by pin 64 (FIG. 12). Frame 60 is mounted to the body of the guitar by four screws 67.

In FIG. 11, the unit 63 is slidable along the slot in which it is dispersed against the surface of the frame 60. The string which is supported by the unit 63 is held thereby at a predetermined stringed height. The string tension causes the unit 63 to be retained relatively strongly against the frame 60 and against the inner surface of the wall 61.

A setscrew 57 is threadedly engaged within the wall 61 for bearing against one surface of the unit 63 so as to push it downward (as viewed in FIG. 12) along the slot in which it is precisely received. The setscrew shown is for intonation adjustment, back and forth, to obtain precise pitch in two different octaves.

The setscrew 62 is threadedly received within a bore which extends completely through the unit 63 so that an end of the setscrew 62 can abut against an interior surface of the frame 60. The setscrew 62 in FIG. 12 is for adjustment of the individual string height. Threading of the setscrew 62 into the unit 63, while an end of the setscrew 62 abuts the frame 60, causes the unit 63 to be raised and thereby tilted due to the passage of the setscrew 62 therethrough and against the surface of the frame 60.

Figure 15:
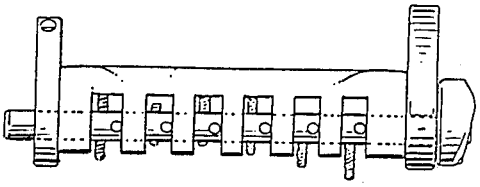
FIG. 15 is an end view of the top half of the multiple tuning bridge with tuning screws adjusted in standard position.
Figure 16:
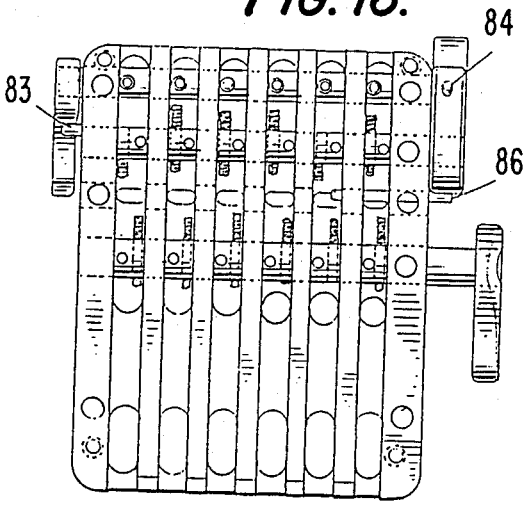
FIG. 16 illustrates the underside of the top plate with camshafts and adjustment screws in starting position.

The cover, shown in FIGS. 14–20, when assembled encloses each of the respective units 63, the cover having a plurality of grooves (unnumbered) as seen clearly in FIGS. 15 and 16. The screws 80 which are threaded through the respective ones of the shafts 75, 76, and 77 are disposed such that, when the supporting shaft carrying the respective setscrew is rotated, an end of the setscrew is rotated against a respective one of the L-shaped pivot arms 66 to depress it. The L-shaped pivot arms 66 are each biased by the string tension so that they would rotate in a clockwise direction if no obstacle were interposed thereagainst. The setscrews thus serve to adjustably position the L-shaped pivot arms under the string tension. Each of the shafts 75, 76, and 77 each carry a plurality of such setscrews, referred to as tuning screws respectively numbered 80, 72, and 74, so that at any given time any one of the respective arms 38, 39, and 37 can be in operable position with the respective tuning screws abutting respective ones of the pivot arms, with the other two shafts being turned to a dormant position.

Figure 17:
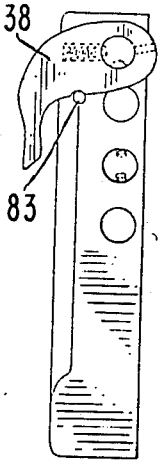
FIG. 17 illustrates a side view of the top plate showing the first quick change lever in locked position.
Figure 18:
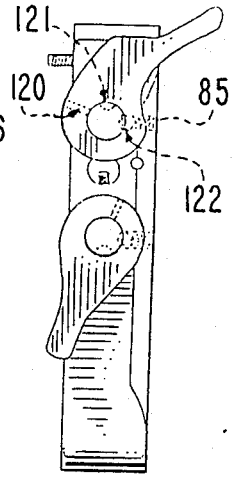
FIG. 18 is an opposite side view of the top cover plate, showing positive lever stop and spring loaded ball stops.

As seen in FIGS. 16, 17, and 18, the handles 38, 39, and 37 are preferably assembled to their respective shaft with a set screw 120 as is conventional. The respective one of the handles can then be positively locked into the appropriate operating position using a depression 121 disposed on the shaft in cooperation with a ball 122 which is in compression against the shaft, the compression being adjustable via a setscrew 85. This permits a positive locking engagement of the shaft, the setscrew 85 being disposed as seen in FIG. 16 in the frame unit cover 40 for coaction with the respective shaft so as to fixedly retain same in an operable position with the respective tuning screws abutting the respective L-shaped pivot arms 66. This positive engagement feature is itself well-known, and any such positive engagement means could be used instead within the scope of the present invention.

The unit 40 could be mounted to any instrument using minor adjustments, but adapts particularly well to solid body instruments.

The top plate of the multiple tuning bridge and key changer shown in FIGS. 14–18, consists of three individual camshafts 75, 77 and 76 which are further adjusted while in the engaged position by the individual tuning screws 72, 74 and 80 and locked in place by the quick change levers 37–39 and further held in position by stop pins 83 and 86. The quick change levers are further held in position by independent spring ball and seat positions 85 for holding quick change levers 37–39 in easy to reach positions, making it easy for performers to go in and out of different tunings while playing a song.

The quick change levers are designed to fit the fingers of the performer to make it easier and faster to enter in and out of different tunings while performing a piece of music.

The top portion of the multiple tuning key changer bridge unit 40 is further designed with elongated slots 70 and oval shaped slots 73, 78 and 79 to enable the musician to adjust the various tunings and string height with an Allen wrench 82 through the slots in said unit 40. The adjustments can be made while the tuning cams are in an active position for a more precise adjustment.

Unit 40 is fastened to the bottom portion by four screws 71 (FIG. 20) and locked in place by using Allen wrench 81 (FIG. 19) and held in perfect alignment by the alignment pins 59 (FIG. 13). It is to be further understood that the multiple tuning changer or key changer referred to by number 40 and the movable capo chord and key modulator shown by 30 were designed to perform in relation with each other to give a musician an added dimension of sound and choices of note relations and frequencies.

Figure 21:
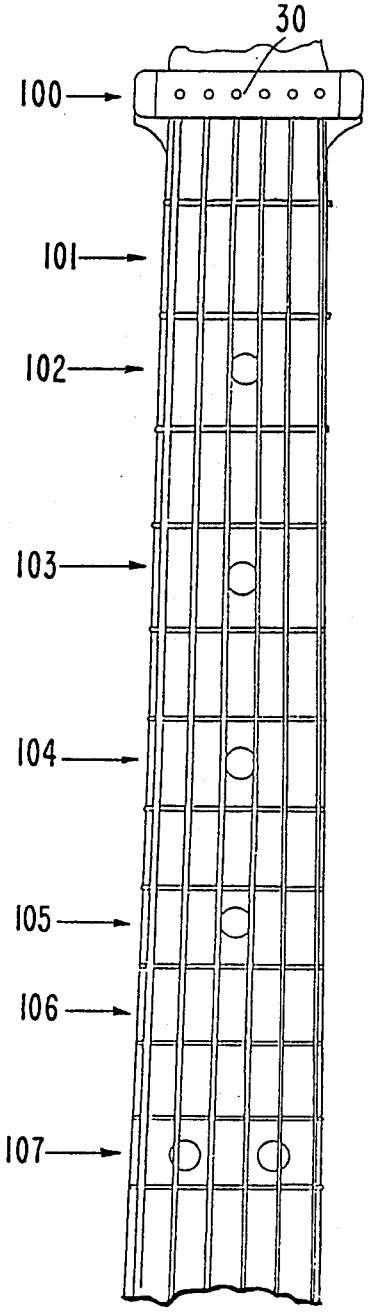
FIGS. 21 and 22 illustrate the various tunings achieved with varying positions of the elements of the present invention.
Figure 22:
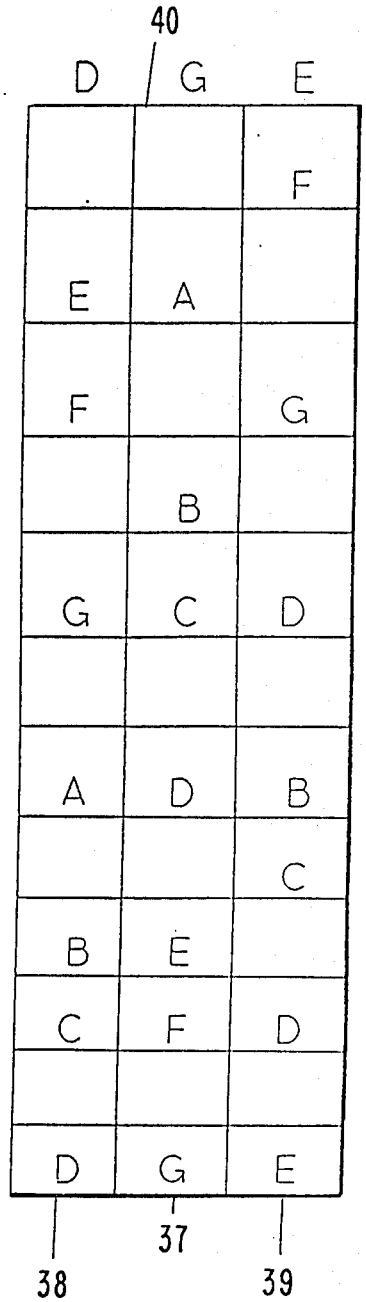

With reference to the units working in harmony with each other, a special chart is provided to better understand what happens when the units work together, as shown in FIGS. 21 and 22.

As shown in FIG. 21, when lever 38 is raised the guitar goes from standard pitch tuning into a open D tuning. When capo unit 30 (FIG. 21) is moved to the position 101 in FIG. 21 one then has an open E tuning shown in related chart FIG. 22. When lever 38 is lowered the instrument goes back in perfect pitch standard tune, and when lever 38 is raised and lever 37 is depressed the instrument goes into a perfect pitch open G tuning. When the unit 30 is moved to position 101 in FIG. 21, it changes to an open A tuning.

By following the steps in FIG. 21 and related steps in FIG. 22, any open tuning key or chord in the chromatic music scale can be had by using the units in cooperation with each other according to the charts in FIGS. 21 and 22.

What is claimed is:

1. An apparatus for use with stringed instruments having a body portion and a neck portion extending from said body portion in a longitudinal direction of the strings, comprising in combination:

an adjustable first key modulating means comprising a bridge slidably mounted on said neck portion of said instrument having a plurality of rollers rotatably mounted in said bridge each of said rollers being in rolling contact with a respective one of said strings for adjusting the effective length of the strings to modulate the key; and a second key modulating means mounted on said body portion of said instrument for selectively changing the tension of the strings;

whereby one or both of said key modulating means may be selectively operated to achieve a desired key.

2. The apparatus as defined in claim 1, wherein said bridge is slidable in a direction generally parallel to said longitudinal direction of the strings.

3. The apparatus as defined in claim 1, further comprising an adjustable resilient biasing means for adjustably biasing each of said rollers against a respective one of said strings.

4. The apparatus as defined in claim 3, wherein said adjustable biasing means includes screw means and a spring means interposed between said adjustable screw means and a respective one of said rollers.

5. The apparatus as defined in claim 3, wherein each of said rollers are housed in an independent housing within said bridge.

6. The apparatus as defined in claim 5, wherein said plurality of rollers are rotatably mounted on independent shafts mounted in each of said independent housings and are capable of movement in a first direction against said biasing means and in a second direction substantially transverse to said first direction.

7. The apparatus as defined in claim 6, wherein a first and last roller mounted in said bridge are biased inwardly toward the other of said plurality of rollers.

8. The apparatus as defined in claim 1, wherein said second key modulating means includes at least one shaft means mounted transversely to said strings having at least one adjustable projecting means extending from said shafts, with said adjustable projecting means being selectively movable into and out of an active position.

9. The apparatus as defined in claim 8, wherein said second key modulating means includes a plurality of said shafts with each shaft including one of said adjustable projecting means for each string of said instrument, with said adjustable projecting means of each of said plurality of shafts being selectively movable into and out of said active position.

10. The apparatus as defined in claim 9, wherein each of said shafts is capable of adjusting said second key modulating means to a predetermined key, with only one of said shafts being moved to said active position to achieve said predetermined key.

11. The apparatus as defined in claim 8, wherein said second key modulating means further includes a plurality of first adjustable string-contacting means and a plurality of second string-contacting means, with one of said first adjustable string-contacting means and one of said second string-contacting means being in contact with a respective one of said strings of said instrument.

12. The apparatus as defined in claim 11, wherein each of said first adjustable string-contacting means comprises an adjustable support including a first and second adjustment means, and a roller rotatably supported by said support, with said support being adjustable in a first direction essentially in said direction of said strings by said first adjustment means and in a second direction essentially transverse to said first direction.

13. The apparatus as defined in claim 11, wherein each of said second string-contacting means comprise an L-shaped member pivotal at each respective vertex about a common pin, said L-shaped member including a first leg supporting a rotatable member for contacting a respective one of said strings and a second leg essentially extending in said direction of said strings and being selectively pivoted by said adjustable projecting means extending from said shaft.

14. An adjustable key modulating device for adjusting an effective length of strings of a stringed instrument having a body portion and a neck portion extending from said body portion in a longitudinal direction of the strings, comprising:

a bridge positioned adjacent to said strings and movable in a direction generally parallel to said longitudinal direction of said strings along said neck portion;

a plurality of string contacting means mounted in said bridge, each of said string contacting means contacting a respective one of said strings, and a plurality of adjustable resilient biasing means for resiliently biasing each of said string contacting means against said respective one of said strings, whereby the tension of said strings remains substantially constant upon completion of the adjustment of said effective length of said strings.

15. The device as defined in claim 14, wherein said plurality of string contacting means comprises a plurality of rollers, each of said rollers being rotatably mounted in said bridge for rolling contact with a respective one of said strings.

16. The device as defined in claim 15, wherein said adjustable biasing means includes an adjustable screw means and a spring means interposed between said adjustable screw means and a respective one of said rollers.

17. The device as defined in claim 15, wherein each of said rollers are rotatably mounted on independent shafts and are capable of movement in a first direction against said biasing means and in a second direction substantially transverse to said first direction.

18. The device as defined in claim 17, wherein a first and last roller mounted in said bridge are biased inwardly toward the other of said plurality of rollers.

19. The device as claimed in claim 14 wherein said neck portion of said instrument includes a pair of parallel guide grooves formed therein in said longitudinal direction for slidably accommodating pair of elements of said bridge to maintain said string contacting means substantially equal distance from said neck after the adjustment of said effective length of said strings.

20. An adjustable key modulating device for selectively changing the tension of strings of stringed instruments having a body portion and a neck portion extending from said body portion in a longitudinal direction of said strings comprising:

a housing mounted on said body portion;

a plurality of shaft means rotatably mounted transversely to the direction of said strings within said housing;

at least one adjustably projecting means extending from each of said shafts and being selectively movable into and out of an active position;

means for permitting and limiting the rotation of said shafts; and a plurality of first adjustable string-contacting means and a plurality of second string-contacting means with one of said first string-contacting means and one of said second string-contacting means being in contact with a respective one of said strings of said instrument with each of said first adjustable string-contacting means including an adjustable support having first and second adjustment means, said support being adjustable in a first direction essentially in said direction of said strings by said first adjustment means and in a second direction essentially transverse to said first direction;

wherein each of said first shaft means is capable of charging the key to a predetermined key, with only one of said shaft means being moved to position said respective adjustable projecting means in said active position to achieve said predetermined key.

21. The device as defined in claim 20, wherein each of said first adjustable string-contacting means further includes a roller rotatably supported by said support and positioned in contact with said string.

22. The apparatus as defined in claim 21, wherein each of said second string-contacting means comprise an L-shaped member pivotal at each respective vertex about a common pin, said L-shaped member including a first leg supporting a rotatable member for contacting a respective one of said strings and a second leg essentially extending in said direction of said strings and being selectively pivoted by said adjustable projecting means extending from said shaft.

23. The apparatus as defined in claim 20, wherein said means for permitting and limiting said rotation of said shafts includes a lever mounted on an end portion of each of said shafts, said lever extending away from said body portion to allow positive operation and at least one stop means mounted on said housing adjacent each of said shafts and cooperating with said lever to limit the rotation of said shaft and accurately position said projecting means in said active position.

* * * * *